US007677568B1

(12) United States Patent
Kurtz

(10) Patent No.: US 7,677,568 B1
(45) Date of Patent: Mar. 16, 2010

(54) TWO-SIDED PUZZLE AND BOX ASSEMBLY

(75) Inventor: Howard Kurtz, Denver, CO (US)

(73) Assignee: Pigment & Hue, Inc., Denver, CO (US)

( * ) Notice: Subject to any disclaimer, the term of this patent is extended or adjusted under 35 U.S.C. 154(b) by 53 days.

(21) Appl. No.: 12/234,536

(22) Filed: Sep. 19, 2008

(51) Int. Cl.
*A63F 9/10* (2006.01)
*B65D 85/20* (2006.01)
*B65D 5/00* (2006.01)

(52) U.S. Cl. ..... 273/157 R; 206/315.1; 229/115

(58) Field of Classification Search ..... 273/157 R, 273/156, 153 R; 434/406, 428, 429; 206/315.1, 206/459.5; 229/115, 116, 116.3, 116.4
See application file for complete search history.

(56) References Cited

U.S. PATENT DOCUMENTS

| | | | | | |
|---|---|---|---|---|---|
| 717,105 | A * | 12/1902 | Mansfield | 273/157 R |
| 1,907,382 | A * | 5/1933 | Birdsall | 273/157 R |
| 1,948,962 | A * | 2/1934 | Decker | 273/157 R |
| 2,984,489 | A | 5/1961 | Parlato | |
| 3,100,642 | A * | 8/1963 | Goldstein | 273/157 R |
| 3,157,343 | A * | 11/1964 | Kendall | 229/115 |
| 3,254,434 | A * | 6/1966 | Gintoft | 229/115 |
| 4,333,652 | A | 6/1982 | Clancy | |
| 4,385,467 | A * | 5/1983 | Samuels | 273/157 R |
| 4,486,018 | A | 12/1984 | Keller, Jr. | |
| 4,943,063 | A * | 7/1990 | Moreau | 273/157 R |
| 4,984,798 | A | 1/1991 | Silberstein | |
| 5,246,161 | A * | 9/1993 | Kapp | 206/459.5 |
| 5,249,802 | A * | 10/1993 | McCarthy | 273/157 R |
| 5,368,301 | A * | 11/1994 | Mitchell | 273/157 R |
| 5,425,499 | A * | 6/1995 | Pfieffer | 229/115 |
| 5,725,382 | A * | 3/1998 | Walter et al. | 206/459.5 |
| 5,957,454 | A | 9/1999 | Libeskind | |
| 6,086,067 | A | 7/2000 | Benoit et al. | |
| 6,213,465 | B1 * | 4/2001 | Jacoby | 273/157 R |
| 6,336,631 | B1 | 1/2002 | Volkert | |
| 6,431,359 | B1 * | 8/2002 | Hollander | 206/459.5 |
| 6,474,641 | B1 * | 11/2002 | Kellock | 273/153 R |

(Continued)

OTHER PUBLICATIONS

Berkshire Puzzle Co., "History of the Jigsaw Puzzle," http://www.berkshirepuzzles.com/history_of_the_jigsaw_puzzle.html, printed Sep. 9, 2008, 2pp.

(Continued)

*Primary Examiner*—Steven Wong
(74) *Attorney, Agent, or Firm*—SoCal IP Law Group LLP; Steven C. Sereboff; John E. Gunther

(57) ABSTRACT

The unassembled puzzle pieces of a two-sided puzzle are stored in a right-triangular box to form a two-sided puzzle and box assembly. A representation of the image on one side of the two-sided puzzle when assembled is on one triangle-leg first side wall. And a representation of the image on the other side of the puzzle is on the triangle-leg second side wall. Thus, the person assembling the puzzle opens the box, dumps the puzzle pieces out and sets the box up generally with the right angle of the box facing her. She can easily then see both image representations by only moving her head slightly as she puts the puzzle together. She may then figure out which up-or-down way to flip the pieces, as she puts the puzzle together. The puzzle assembly method is also disclosed.

22 Claims, 4 Drawing Sheets

U.S. PATENT DOCUMENTS

| | | | | |
|---|---|---|---|---|
| 6,672,588 | B1 | 1/2004 | Kielar et al. | |
| 7,011,215 | B2 | 3/2006 | Meissen et al. | |
| 7,410,062 | B2 | 8/2008 | Monk | |
| 2007/0057458 | A1 | 3/2007 | Haag | |
| 2007/0152400 | A1 * | 7/2007 | Cooper | 273/157 R |
| 2008/0136099 | A1 | 6/2008 | Frost | |

OTHER PUBLICATIONS

Dixon, Angie, "The History of Jigsaw Puzzles," http://jigzoneshop.com/catalog/article_info.php?articles_id=13, printed Sep. 9, 2008, 2pp.

McAdam, Daniel, "History of Jigsaw Puzzles," American Jigsaw Puzzle Society, http://www.jigsaw-puzzle.org/jigsaw-puzzle-history.html, printed Sep. 9, 2008, 3pp.

Wikipedia, "Jigsaw puzzle," http://en.wikipedia.org/wiki/Jigsaw_puzzle, printed Aug. 19, 2008, 4pp.

Williams, Anne D., "Jigsaw Puzzles—A Brief History, . . . 1760s to Modern Day . . . ," http://www.wooden-jigsaw-puzzles.com/mgcpuzzles/puzzle_history, printed Sep. 9, 2008, 8pp.

* cited by examiner

TWO-SIDED PUZZLE AND BOX ASSEMBLY

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Jigsaw puzzles have been entertaining and educating children and adults for many years. John Spilsbury, an engraver and mapmaker, is credited with inventing the jigsaw puzzle back in 1767. His first jigsaw puzzle was a map of the world with a map attached to a piece of wood. The countries were finely cut out as the puzzle pieces and provided an educational tool for children as they put the puzzle together. In the early 1900's, puzzles were marketed to and became very popular with adults. Presently, cardboard is more frequently used than wood as the puzzle substrate and various images in addition to maps are used providing education and entertainment to people of all ages.

DETAILED DESCRIPTION

Figure 1:
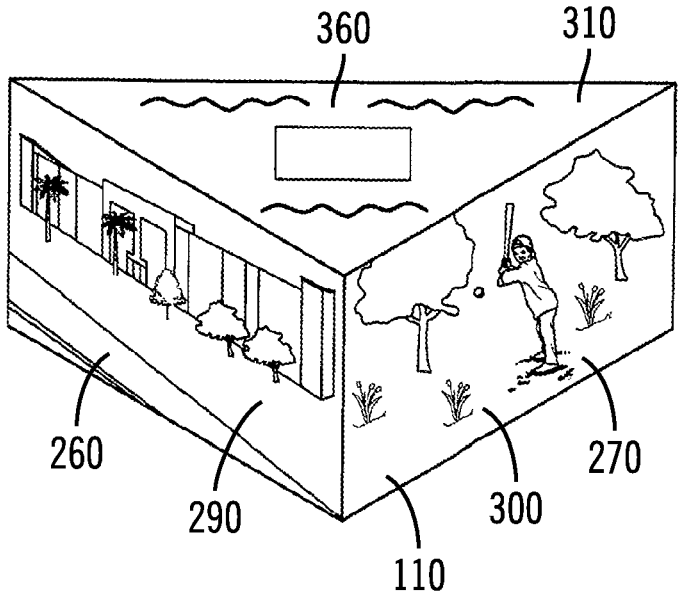
FIG. 1 is a perspective view of a puzzle box.
Figure 2:
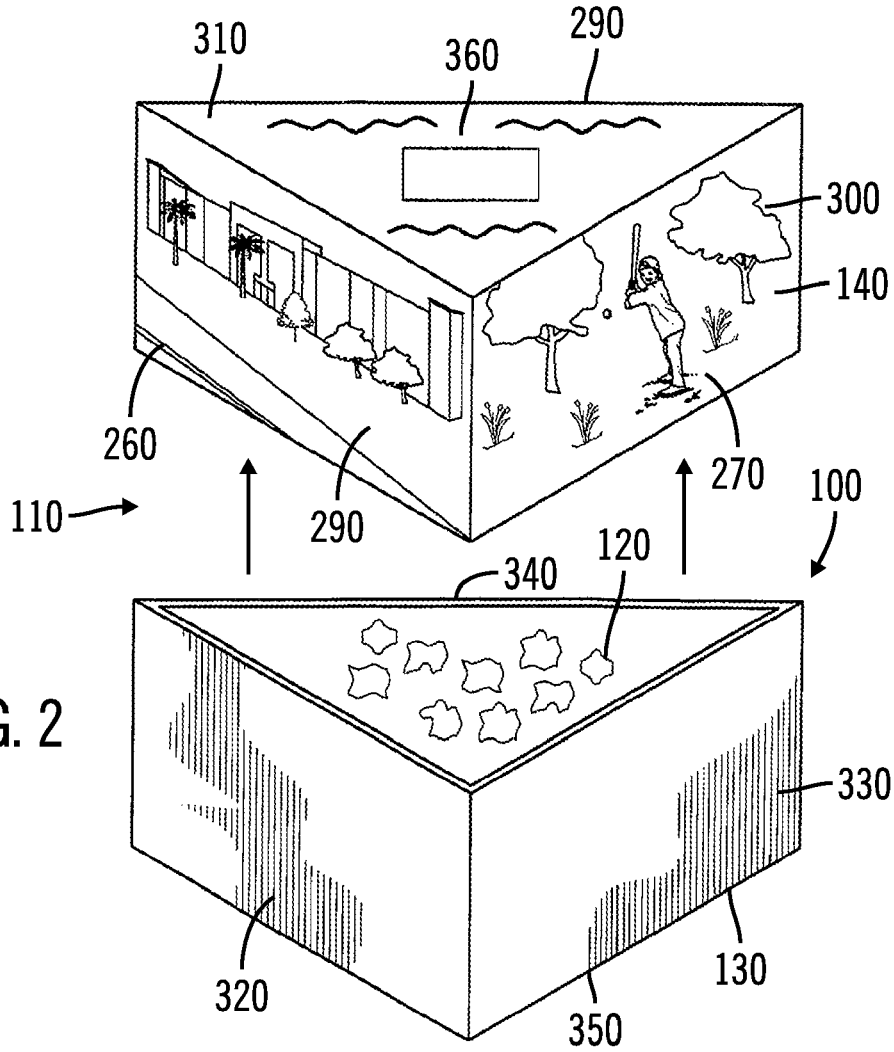
FIG. 2 is a perspective view of the puzzle box of FIG. 1 showing the lid thereof removed from the bottom tray thereof and puzzle pieces in the bottom tray.

Referring now to the drawings, wherein like reference numerals designate identical or corresponding parts throughout the several views, a two-sided puzzle and box assembly is illustrated generally at 100. The assembly 100 includes a box 110 and puzzle pieces 120. The box 110 includes a bottom tray 130 and a top lid 140. FIG. 1 depicts the box 110 in a closed position with the lid 140 in position on the tray 130. FIG. 2 shows the lid 140 lifted off of the tray 130 providing access to the tray so that the puzzle pieces 120 can be removed from or inserted into the tray.

The puzzle pieces 120 when in the box are in fully or at least substantially fully disassembled condition, that is, sometimes some of the pieces may be locked together but generally they are completely separate. To remove the puzzle pieces 120 from the box 110 the user typically dumps them out onto a table or other surface (not shown). The user, by orienting and manipulating the puzzle pieces 120, assembles them into an assembled two-sided puzzle as depicted generally at 150 in FIGS. 3 and 4, for example. The puzzle pieces 120 may be interlocking or other type of puzzle pieces as are known to those skilled in the art. Generally, any number of puzzle pieces may be provided in the assembly 100, and examples are fifty pieces and one hundred pieces. While a fifty piece puzzle may be adapted for use by children, a one hundred piece puzzle may be better suited for use by adults.

Figure 3:
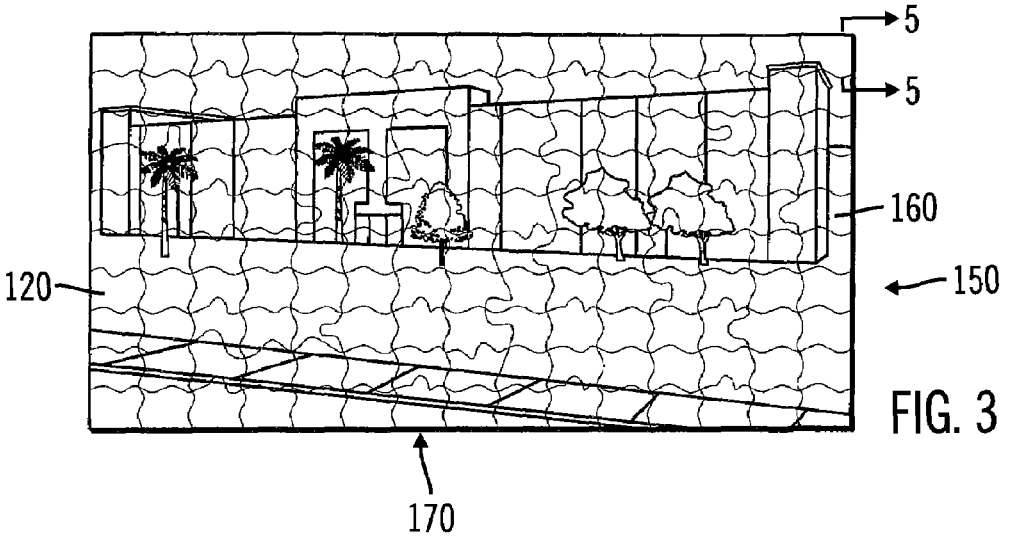
FIG. 3 is a plan view of the first side of a two-sided puzzle formed by the puzzle pieces of FIG. 2 removed from the box and assembled together.
Figure 4:
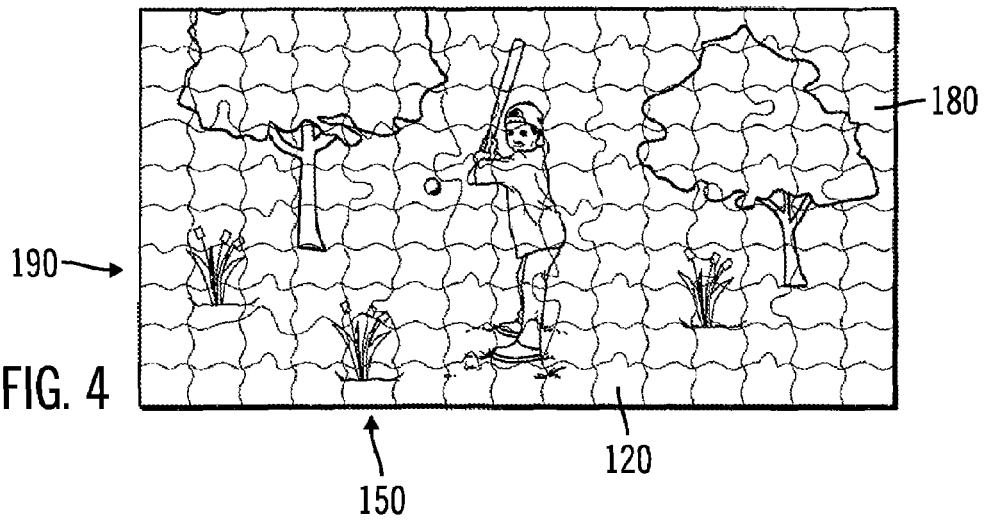
FIG. 4 is a plan view of the second side of the two-sided puzzle of FIG. 3.

The two-sided puzzle 150 may be planar as depicted in the drawings, or non-planar. The two-sided puzzle 150 has a first side as shown in FIG. 3 at 160 with a first image 170, and a second side as shown in FIG. 4 at 180 with a different second image 190. The images 170, 190 may be "thematically related," as explained below. By having them thematically related, the present assembly 100 may be more interesting to the user and to potential purchasers. It further may make the assembly 100 a learning tool, especially for children as they learn to associate related images.

The following are examples of "thematically related" images with the title listed first followed by the two images. (1) George Washington: portrait of George Washington and painting of George Washington; (2) Thomas Jefferson: portrait of Thomas Jefferson and photo of the Jefferson Memorial; (3) Abraham Lincoln: photo of Lincoln Memorial and painting of the Emancipation Proclamation; (4) Theodore Roosevelt: Portrait of Theodore Roosevelt and painting of the Rough Riders; (5) Paul Cezanne: painting of "Still Life" and painting of "The Card Players"; (6) Mary Cassatt: painting of "Tea" and painting of "Mother"; (7) Vincent van Gogh: painting of "The Bedroom" and painting of "Wheatfield"; (8) Claude Monet: painting of "Water Lilies" and painting of "The Station"; (9) New York: view of New York City and photo of the Statue of Liberty; (10) Philadelphia: photo of the Liberty Bell and photo of the Love Statue; (11) Chicago: photo of Buckingham Fountain and photo of Water Tower; (12) San Francisco: photo of the Golden Gate Bridge and photo of a cable car; (13) Los Angeles: photo of the Hollywood Sign and photo of Venice Beach; (14) Recycle, Reduce, Reuse: photo of plastic bottles and photo of bamboo; (15) Art Supplies: sketch of art supplies and sketch of color swatches; (16) Day of the Dead: sketch of "Skeletons Dancing" and sketch of "La Catrina"; (17) Passover: sketch of Egyptian pillars and sketch of Seder Plate.

Additional examples are: (18) Water: picture of steam from a kettle and picture of ice cubes from an ice cube tray; (19) Butterflies: picture of caterpillar and picture of butterfly; and (20) Christianity: painting of baby Jesus and painting of Jesus on the cross. Examples (18) and (19) may be used as educational tools for children at home or in school.

Figure 5:
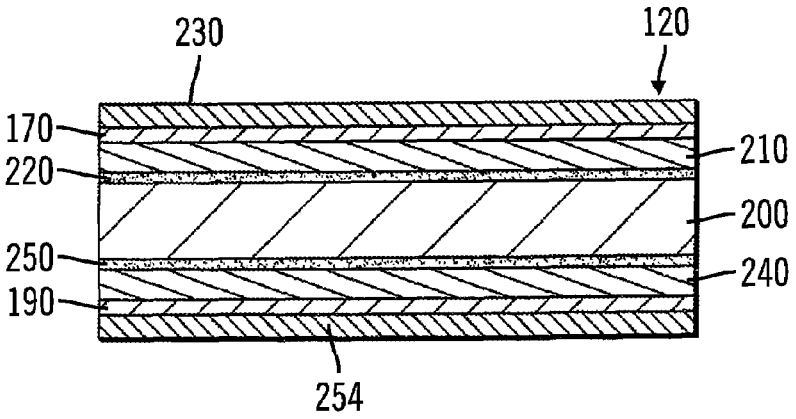
FIG. 5 is an enlarged cross-sectional view taken on line 5-5 of FIG. 3.

The assembled two-sided puzzle 150 and each of its puzzle pieces 120 may be constructed to include as illustrated in FIG. 5 a central cardboard support sheet 200 (e.g., duplex gray board), with a first paper (or other) sheet 210 adhered to a first surface with a layer of glue or other adhesive 220. The first paper 210 has the first image 170 thereon or therein, and the first paper may be coated with varnish 230 or the like. Similarly, a second paper (or other) sheet 240 is adhered to an opposite second surface with a layer of glue or other adhesive 250. The second paper 240 has the second image 190 thereon or therein, and the second paper similarly may be coated with varnish 254 or the like. Other puzzle constructions which are known to those skilled in the art may be used herein.

The box 110 may have a triangular configuration as can be understood from the drawing figures. The cover or lid 140 thereby has a first side wall 260 which defines a first leg of the triangle, a second side wall 270 which defines a second leg of the triangle, and a third side wall 280 which defines the hypotenuse of the triangle. A representation 290 of the first image 170 is on the first side wall 270, and a representation 300 of the second image 190 is on the second side wall 270. A triangular top piece or ceiling 310 connects the three walls. The triangle may be a right triangle and particularly an isosceles right triangle with both legs having the same length. Instead of a right angle, the angle may be between ninety and one hundred degrees, for example.

Figure 6:
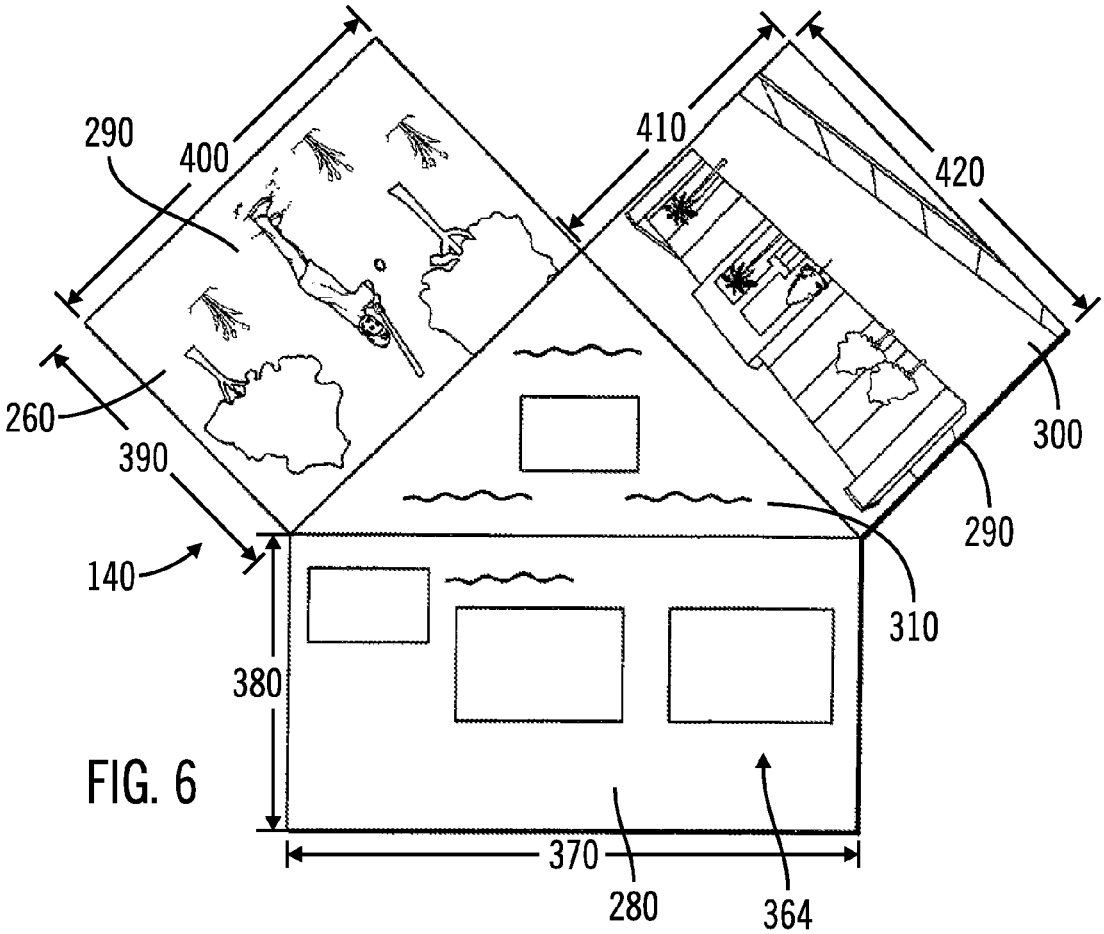
FIG. 6 is a plan view of the lid of FIG. 2 in a lay-flat condition.

The bottom tray 130 has side walls 320, 330, 340 and a floor 350, as shown in FIG. 2. The lid 140 and tray 130 may be formed of cardboard or other material as would be apparent to those skilled in the art. The ceiling 310 of the lid 140 may have indicia 360 thereon with title, manufacturer, retailer, assembly explanations, pricing or the like. The hypotenuse side wall 280 may also have indicia 364 (FIG. 6) thereon such as both of the representations or indicia similar to these mentioned above for the ceiling 310.

"Images" includes pictures, photographs, drawings, paintings, sketches, text, reproductions and representations thereof. The "representation" of the images may be the images themselves or photos, copies, reproductions, representations or pictures of the images or of the underlying picture, photograph, painting, etc. The "representations" may be smaller, larger or the same size as the images. The representations will typically be the entire image but may be less than the entire image. The representations may cover the entire walls (as pictured in FIG. 1, for example) or less than the entire walls The box 110 may be dimensioned to accommodate different images or representations thereof. For example, the three walls 260, 270, 280 of the lid (and/or tray) as depicted in the lay-flat configuration thereof illustrated in FIG. 6 may have dimensions 370, 380, 390, 400, 410, 420 of 8.5, 4.4, 4.4, 6, 4.4 and 6 or 8.3, 4.3, 4.3, 5.88, 4.3 and 5.88, inches, respectively. This may be used for example when the representations have longer length than width/height dimensions as in a landscape orientation.

Figure 8:
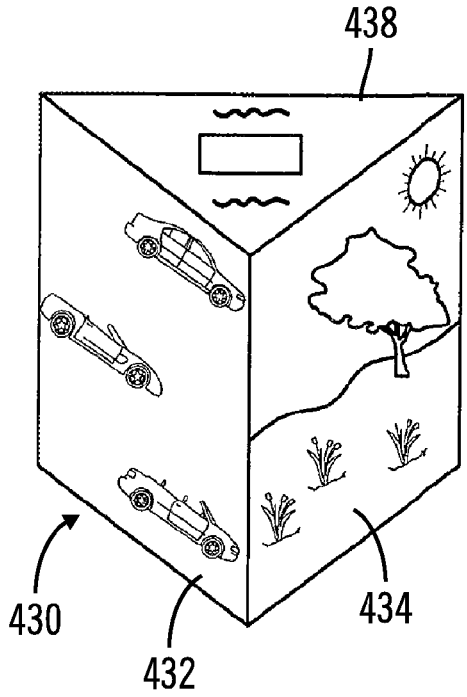
FIG. 8 is a perspective view of an alternative box similar to FIG. 1 but differently dimensioned and with the image representations thereon in portrait instead of landscape orientations.
Figure 9:
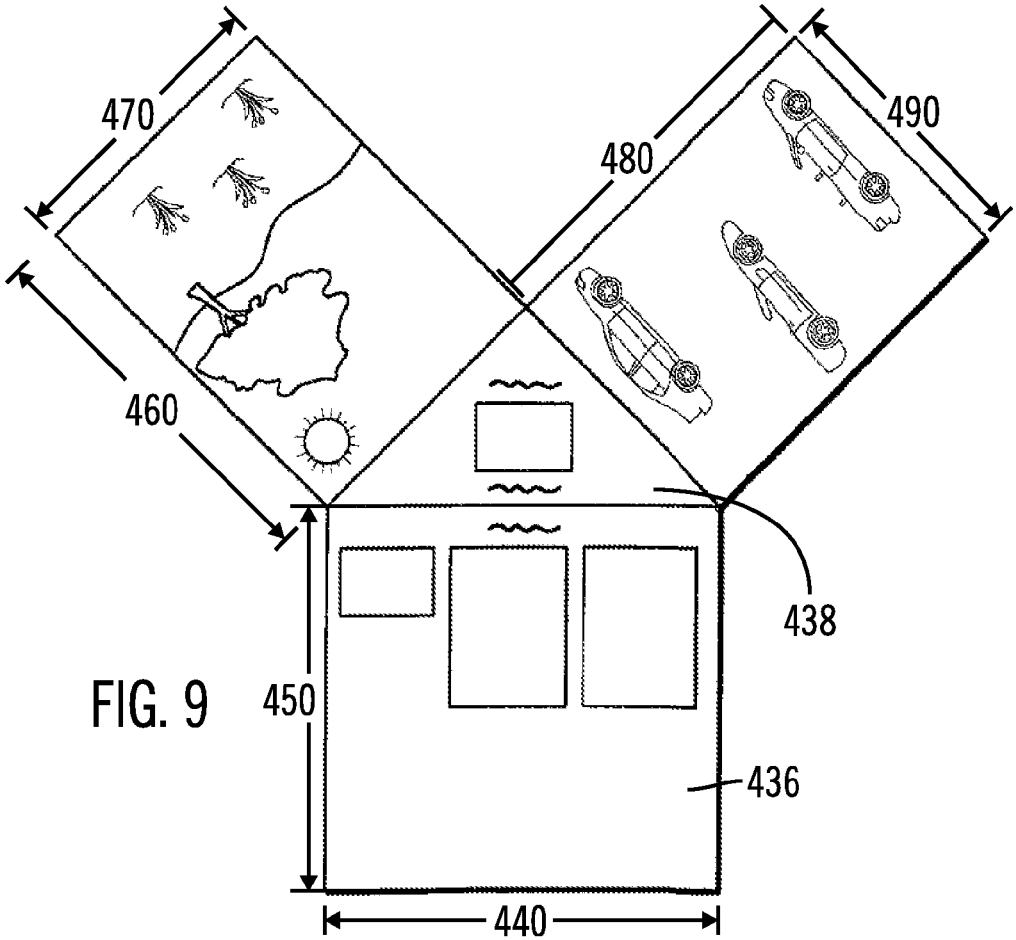
FIG. 9 is a plan view of the lid of the box of FIG. 8 in a lay-flat condition.

Another configuration of the box (110) as shown generally at 430 in FIGS. 8 and 9 has three walls 432, 434, 436 with longer height/width dimensions than length dimensions and a ceiling 438. Representative dimensions 440, 450, 460, 470, 480, 490 as shown in the lay-flat configuration for the lid (and/or tray) may be 6.22, 6, 6, 4.4, 6 and 4.4 or 6.0, 5.88, 5.88, 4.3, 5.88, and 4.3 inches, respectively. This configuration may be used for example when the representations are in a portrait orientation.

With all (or some) of the puzzle pieces 120 removed from the tray 130 (or less preferably still in the tray), the lid 140 either separate from or on the bottom tray may be oriented with the right angle between the two leg side walls 260, 270 facing the user and thereby in a "forward facing" position relative to the user as the user is assembling the puzzle pieces into the assembled puzzle 150. When "forward facing" the user can see both the first and second representations 260, 270 by only moving his eyes and/or head slightly, and/or by moving the lid slightly. This assists the user in putting the puzzle together. In particular, as she looks at each piece 120 and then one or both of the representations, she is assisted in determining in which "up or down" orientation the piece should be in to form the desired first or second image 170, 190. She may also see the representation of the desired image to help her position (and interlock) the pieces to form the desired image.

When the lid 140 is forward facing it can be resting on the same surface as the puzzle pieces. For example, the forward facing lid can be on the table surface with the puzzle pieces also on the table and between the lid and the user. The lid may be on or off of the tray. Or the lid may be to one side of the pieces. Or the user may be holding the lid in one of her hands and manipulating the puzzle pieces with her other hand.

After the puzzle pieces 120 have been assembled into the puzzle 150 as shown in one of either FIG. 3 or FIG. 4, the assembled puzzle may be flipped over to show the other side and image as shown in the other of FIGS. 3 and 4. The puzzle 150 may then be disassembled (taken apart) and the user assemble the puzzle pieces 120 in the orientation of the other image and in a similar manner.

When the user is through, she may keep the assembled puzzle 150 in an assembled condition for display purposes, for example. Or more likely she may take the puzzle 150 apart completely or nearly completely and put the puzzle pieces 120 back into the tray 130 and cover the tray with the lid 140, and store the assembly 100 for later use.

Figure 7:
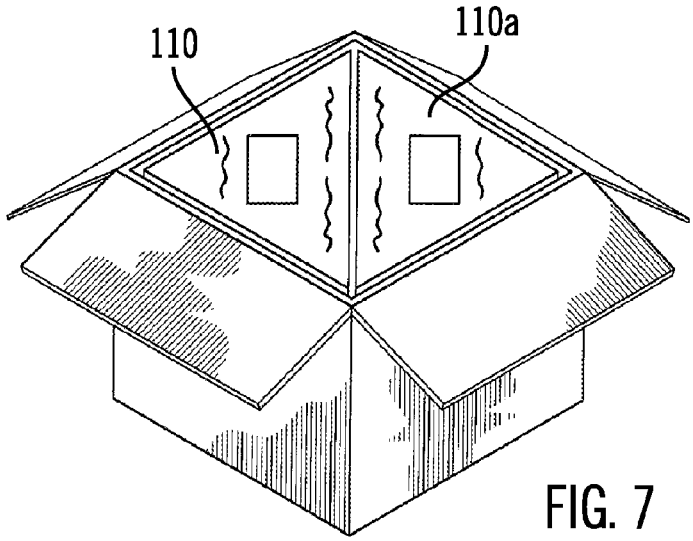
FIG. 7 is a perspective view of a storage box or carton holding the box of FIG. 1 and a similar box.

When the assembly 100 is being displayed for retail purposes it may be displayed in a similar "forward facing" orientation on a store shelf so that potential users may simultaneously see both representations. Or it may be displayed with any one of the side walls forward facing. Or it may be displayed/stored with two boxes adjacent one another, more particularly with their hypotenuse legs adjacent one another to form a cube (where the triangle is an isosceles right triangle.) This adjacent positioning is shown in FIG. 7 where two boxes (assemblies) 110, 110*a* are depicted compactly boxed in a storage box or carton 520. The storage box or carton 520 may be large enough to hold more than one pair of boxes such as in multiple rows and/or columns.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to method, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. Also, as used herein, a "set" of items may include one or more of such items. Additionally, as used herein, "and/or" means that the listed items are alternatives, but the alternatives also include any combination of the listed items.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The invention claimed is:

1. An assembly comprising:

a plurality of puzzle pieces which can be assembled together as an assembled puzzle having a first side and an opposite second side with a first image thereby formed on the first side and a different second image thereby formed on the second side;

a box adapted to store the puzzle pieces when in an at least substantially unassembled condition;

the box being shaped as a triangle with a first side wall of the box defining a first leg of the triangle, a second side wall of the box defining a second leg of the triangle and a third side wall of the box defining a hypotenuse of the triangle;

a representation of the first image but not the second image on the first side wall; and a representation of the second image but not the fist image on the second side wall.

2. The assembly of claim 1 wherein the box includes a bottom tray and a lid, and the lid includes the first, second and third side walls.

3. The assembly of claim 2 wherein the lid includes a triangular ceiling on top of the first, second and third side walls.

4. The assembly of claim 1 wherein the first and second images are thematically related.

5. The assembly of claim 1 wherein the assembled puzzle is substantially planar.

6. The assembly of claim 1 wherein the puzzle pieces are interlocking puzzle pieces.

7. The assembly of claim 1 wherein the first and second side walls have height and length dimensions of approximately 4.4 and 6 inches, respectively.

8. The assembly of claim 1 wherein the first and second side walls have height and length dimensions of approximately 6 and 4.4 inches, respectively.

9. The assembly of claim 1 wherein the triangle is an isosceles right triangle.

10. The assembly of claim 1 wherein the box includes a bottom tray and a top lid removable off therefrom.

11. The assembly of claim 1 wherein the first and second images are both in landscape orientations.

12. The assembly of claim 1 wherein the first and second images are both in portrait orientations.

13. A puzzle assembling method, comprising:

removing puzzle pieces from a box;

the puzzle pieces being adapted to be assembled together when removed from the box in an assembled puzzle having a first side with a first image thereon formed by the puzzle pieces and an opposite second side with a different second image thereon formed by the puzzle pieces;

the box being configured generally as a right triangle having a first leg, a second leg, and a hypotenuse;

the first and second legs joining at a right angle edge;

the box having a first leg side wall, a second leg side wall and a hypotenuse side wall;

the first leg side wall having thereon a representation of the first image but not the second image and the second leg side wall having thereon a representation of the second image but not the first; image assembling the puzzle pieces from the box into the assembled puzzle with the first image being upwardly disposed;

the assembling including with the puzzle pieces being in an at least partially disassembled state and the right angle edge being forward facing, looking at the representations of the first and second images to help decide which side of at least some of the pieces should be facing up and which side should be facing down and so orienting at least some of the pieces;

the assembling including manipulating at least some of the pieces to abut other of the pieces to form the assembled puzzle; and the manipulating including looking at the representation of the first image.

14. The method of claim 13 wherein the assembling is after the removing.

15. The method of claim 13 wherein the manipulating includes interlocking the puzzle pieces together.

16. The method of claim 13 wherein the first and second images are thematically related.

17. The method of claim 13 wherein the manipulating is at least substantially after the orienting.

18. The method of claim 13 wherein at least a portion of the looking is with the right angle edge being forward facing.

19. The method of claim 13 wherein at least a portion of the looking is with the first side wall being forward facing.

20. The method of claim 13 wherein the triangle is an isosceles right triangle.

21. The method of claim 13 wherein the box has a top lid and a bottom tray and the removing includes removing the top lid from off of the bottom tray.

22. The method of claim 13 further comprising stacking the box next to a similar box with the hypotenuse side wall adjacent a similar hypotenuse side wall of the similar box to form a cube therewith.

* * * * *